US006273557B1

(12) United States Patent
Milligan et al.

(10) Patent No.: US 6,273,557 B1
(45) Date of Patent: Aug. 14, 2001

(54) MICROMACHINED INK FEED CHANNELS FOR AN INKJET PRINTHEAD

(75) Inventors: Donald J. Milligan; Chien-Hua Chen, both of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/408,116

(22) Filed: Sep. 29, 1999

Related U.S. Application Data

(63) Continuation-in-part of application No. 09/033,987, filed on Mar. 2, 1998.

(51) Int. Cl.[7] ..... B41J 2/05
(52) U.S. Cl. ..... 347/65
(58) Field of Search ..... 347/63, 65, 67, 347/70

(56) References Cited

U.S. PATENT DOCUMENTS 4,894,664 * 1/1990 Isung Pan ..... 347/65
5,308,442 5/1994 Taub et al. ..... 347/65
5,387,314 * 2/1995 Baughman et al. ..... 347/65
5,441,593 8/1995 Baughman et al. ..... 347/65

FOREIGN PATENT DOCUMENTS

0841167A2 5/1998 (EP) ..... B41J/2/16

* cited by examiner

*Primary Examiner*—John Barlow
*Assistant Examiner*—Juanita Stephens

(57) ABSTRACT

An inkjet print cartridge comprising a printhead that is formed using a sequence of etch process steps is described. The first etch of the two etch step process is comprised of a wet chemical etch. A dry etch process follows. Both etch steps are consecutively initiated from the back of the wafer. The fabrication process described offers several advantages including precise dimensional control of the ink feed channel, greater packing density of ink ejectors disposed in the printhead and greater printing speed. Additionally, the time required to manufacture the printhead, in contrast to a conventional printhead, is reduced.

25 Claims, 11 Drawing Sheets

MICROMACHINED INK FEED CHANNELS FOR AN INKJET PRINTHEAD

This invention is a continuation in part of application Ser. No. 09/033,987, filed on behalf of Chien-Hua Chen, et al., on Mar. 2, 1998. This invention relates to inkjet printheads and more specifically, to a method and apparatus for channeling ink from a reservoir to an ejecting nozzle.

FIELD OF THE INVENTION

BACKGROUND OF THE INVENTION

Thermal inkjet printers have experienced a great deal of commercial success since their inception in the early 1980's. The fundamental principles of how thermal inkjet printers work is analogous to what happens when a pot of coffee is made. Using the electric drip coffee maker analogy, water is poured into a container (reservoir) and is channeled towards a heating element that is located at the base of the container. Once the coffee has been placed in the filter, the coffee maker is turned on and power is supplied to the heating element that is surrounded by water. As the heating element reaches a certain temperature, some of the water surrounding it changes from a liquid to a gas, thus, creating bubbles within the water. As these "super heated" bubbles are formed, heated water surrounding these bubbles is pushed from the reservoir into a tube and finally into the carafe. Referring now to the thermal printhead, ink is located in a reservoir that has a heating element (heater resistor) at its base. When the heater resistor is turned on for a certain amount of time (pulsed by electronic circuitry) corresponding to a certain temperature, the ink surrounding the heater resistor changes from a liquid to gas phase, thus, creating a bubble that pushes surrounding ink through an orifice and finally onto a printing medium (carafe). The aforementioned example radically simplifies inkjet technology. For a more detailed treatment of the history and fundamental principles of thermal inkjet technology, refer to the *Hewlett-Packard Journal*, Vol. 36, No. 5, May 1985.

In the coffee maker analogy, the water was poured into a container (reservoir) and channeled to a heating element located at its base. This channeling, for an inkjet cartridge, may be accomplished in a variety of different ways with the objective being to simultaneously provide the ink ejecting heater resistors with a continuous supply of ink.

The ink channel has traditionally been a challenging feature to fabricate both in terms of manufacturing repeatability and manufacturing cost. When manufacturing a multiplicity of printheads, variation in critical dimensions can be cataclysmic. For example, if a channel's width is too narrow, it may restrict the flow of ink to the heater resistor(s) consequently causing variations in the volume of ink ejected onto the printing medium. Likewise, if the channel width is too large, ink may be more readily supplied to some heater resistors than others thus creating variations in the rate at which ink may be ejected from the printhead nozzles (hence, the distance through which ink travels before reaching the heater resistor impacts the speed/frequency at which the printhead operates).

In terms of cost, traditional techniques of fabricating ink feed channels involved "sand blasting" holes into a substrate as disclosed in U.S. Pat. No. 5,681,764. This technique, although effective, required very specialized equipment that varied significantly from conventional IC processing thus requiring special facilities, personnel, and equipment. Consequently, there has been many efforts in the inkjet printing community to develop techniques for fabricating ink feed channels wherein the channel dimensions could be accurately controlled using standard IC manufacturing equipment and methodology. The following US patents describe such methods and techniques in an attempt to remedy the aforementioned problem.

U.S. Pat. No. 5,308,442 illustrates a method for isotropically etching ink feed channels employing wet chemical etching. This technique incorporates standard integrated circuit (IC) photolithography and wet etch processing methodology and provides an alternative to the traditional sand blasting approach. Additionally, it provides an improvement over the sand blasting technique wherein the path through which ink flows prior to reaching the heater resistor is shortened. This technique, however, is based purely on conventional anisotropic wet chemical etching (hereafter referred to as wet etching) from the backside of the wafer/wafer substrate subsequently limiting the dimensional control of the ink feed channel. The backside of the wafer refers to the side opposite of where nozzles will be formed.

U.S. Pat. No. 5,387,314 discloses a technique for channeling ink from a reservoir to a heater resistor by utilizing photolithography techniques with a combination of wet etching and plasma etching (a conventional gaseous etching technique hereafter referred to as dry etching). A semiconductor wafer, such as a silicon wafer, is used with a known crystallographic orientation to accommodate channels through which ink flows to the heater resistor. Such a wafer can be etched in two prominent process steps: Firstly, trenches are anisotropically etched part way into the semiconductor from the backside of the substrate. Secondly, an isotropic dry etch is used to etch from the front side (the side upon which nozzles are formed) of the substrate thus creating a channel through the substrate. The advantages of this technique as compared to that previously described in U.S. Pat. No. 5,308,442, is that the front side dry etch offers a greater degree of dimensional control. As this is well know in the semiconductor industry, isotropic wet etch processes are, in general, more variable than dry etch processes. Combining both dry and wet etch processing was a major step whereupon dimensional control of the ink feed channel was improved. However, the aforementioned process introduces an isotropic dry etch step from the front side of the wafer thus requiring the substrate above the ink feed channel to be void of active devices or signal lines.

Many of the aforementioned challenges associated with the fabrication of ink feed channels still persist. Consequently, there remains an opportunity to develop a manufacturing process and apparatus wherein: (1) ink feed channels dimensions can be precisely controlled, (2) the distance through which ink flows before reaching the heater resistor can be minimized, (3) and the time required to form the ink feed channel is reduced.

SUMMARY OF THE INVENTION

An inkjet print cartridge comprises a printhead which further comprises a substrate having at least one crystallographic orientation and opposed planar surfaces. A dielectric film is disposed on a first opposed substrate surface and a second opposed substrate surface. A first portion of the ink feed channel is formed commencing from the second opposed substrate surface and concluding between the opposed substrate surfaces. A second portion of the ink feed channel is then etched commencing from the conclusion of the first etch there by forming a channel completely through the substrate and terminating at the first disposed dielectric film. An opening positioned above the ink feed channel is formed in the dielectric film whereby ink flows through the channel from an ink reservoir. Additionally, the formation of the first portion of the ink feed channel may conclude at an etchstop disposed between the opposed planar surfaces.

BRIEF DESCRIPTION OF THE DRAWINGS

The present invention can be further understood by reference to the following description and attached drawings. Other features and advantages will be apparent from the following detailed description of a preferred embodiments taken in conjunction with the accompanying drawings which illustrate, by way of example, the principles of the invention.

DETAILED DESCRIPTION OF THE PREFERRED EMBODIMENTS

Many of the aforementioned challenges associated with the fabrication of ink feed channels have been resolved through preferred embodiments of the present invention wherein both wet and dry etches are employed to define the ink feed channel. Unlike the process described in U.S. Pat. No. 5,308,442, however, both processes are performed from the back side of a silicon wafer which is defined, hence forth, as the side of the wafer opposite to where ink is ejected onto a paper medium. This technique offers several advantages including greater alignment tolerances, shorter ink feed paths (allowing for a higher frequency printhead), selective positioning of the ink feed holes relative to the heater resistor, and significantly higher packing density of the heater resistors (heater resistor and power traces may be disposed in the surface above the ink feed channel).

Figure 1A:
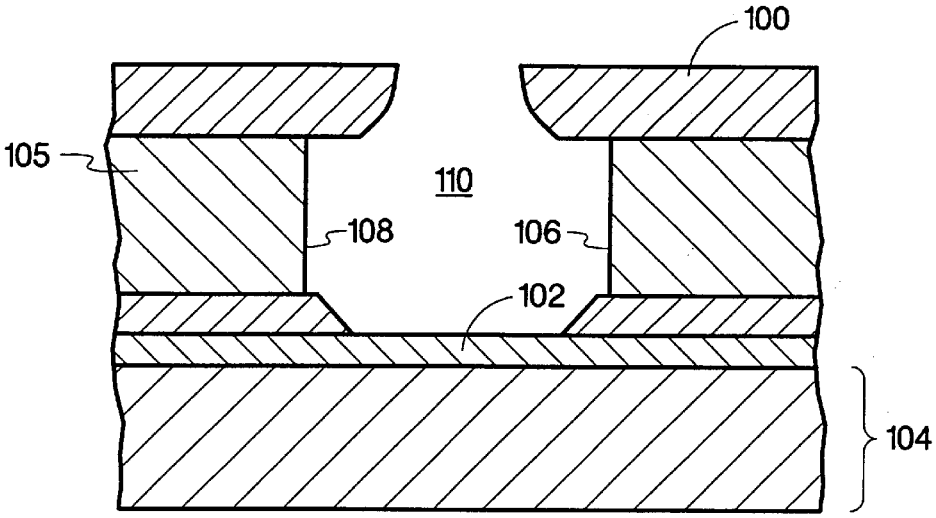
FIG. 1A is a cross section of a conventional printhead showing a material stack which may comprise an ink ejecting apparatus of the printhead.
Figure 1B:
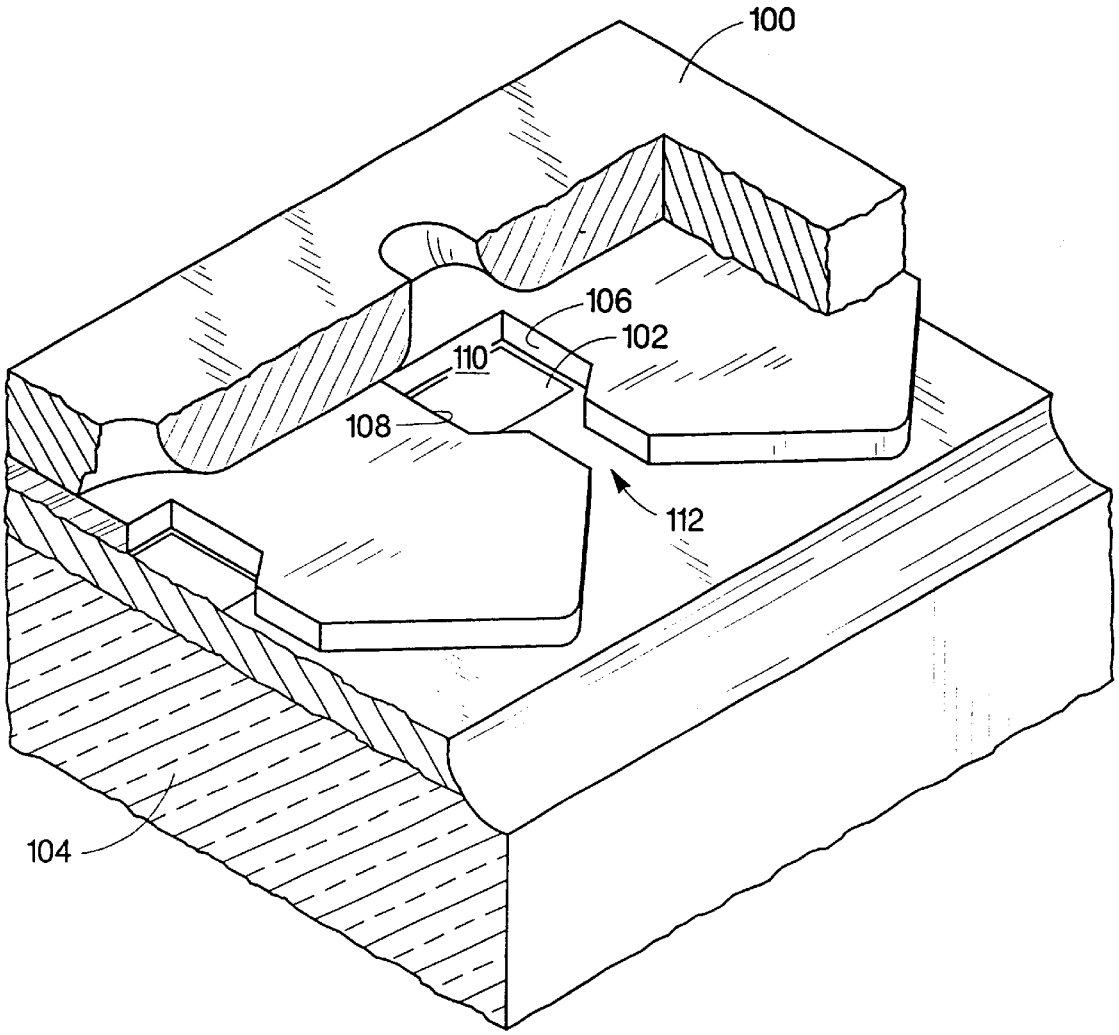
FIG. 1B is a perspective view of a printhead showing an ink feed channel and material stack.
Figure 2:
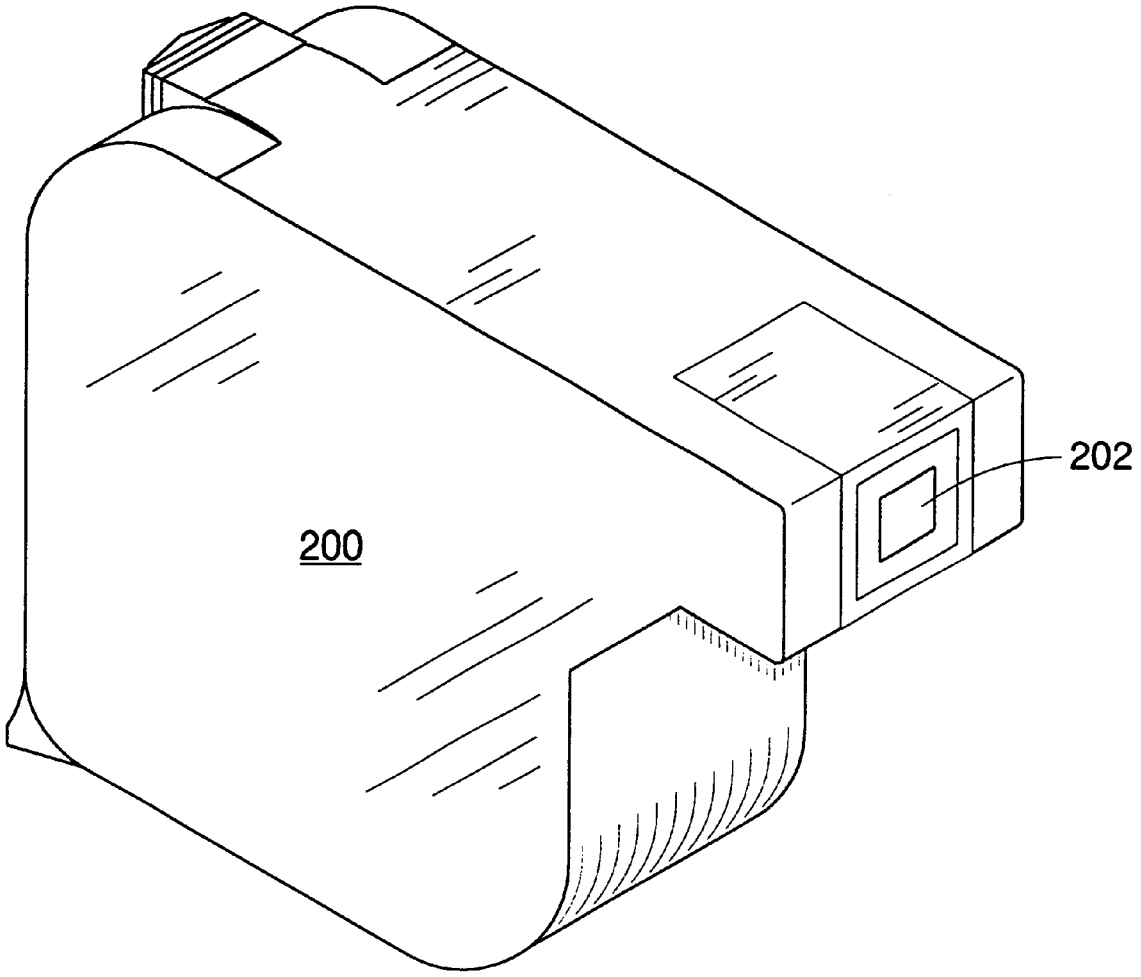
FIG. 2 illustrates print cartridge body to which the printhead is attached.

A cross-section of a conventional printhead is shown in FIG. 1A. The conventional printhead is comprised of several individual layers of material constructed and assembled to perform its function. An orifice plate 100 forms the outermost layer of the printhead and is in close proximity of a printing medium. A plurality of heater resistors 102, more generally referred to as ink ejectors, is created by disposing resistive and conductive materials on the surface of a silicon wafer 104. An ink barrier layer 105 is selectively deposited on top of the silicon wafer 104 surface so that the inner walls 106, 108 form a firing chamber 110. In the conventional printhead, the ink barrier material is distinguished from the orifice plate material 100. Additionally, as shown in FIG. 1B, ink can only flow 112 into the firing chamber 110 from the perimeter of the heater resistor. This differs substantially from one embodiment of the present invention wherein ink may enter the firing chamber from the perimeter of the heater resistor and from beneath the heater resistor (ink feed channel is located directly beneath the heater resistor) as well. Once the conventional printhead has been fabricated, it is attached to an inkjet cartridge 200 at location 202 as shown in FIG. 2. The inkjet cartridge 200 is a fractionally hollow plastic housing comprising one or more ink containment components.

Figure 3A:
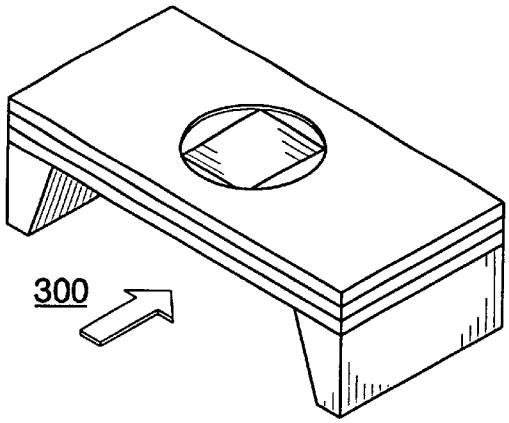
FIGS. 3A–C shows views of a printhead that may use the present invention.
Figure 3B:
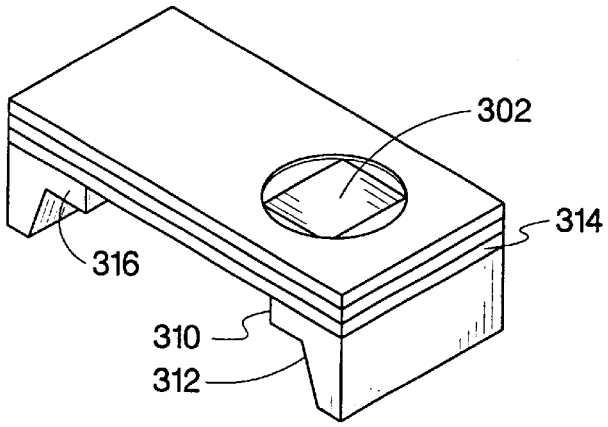
Figure 3C:
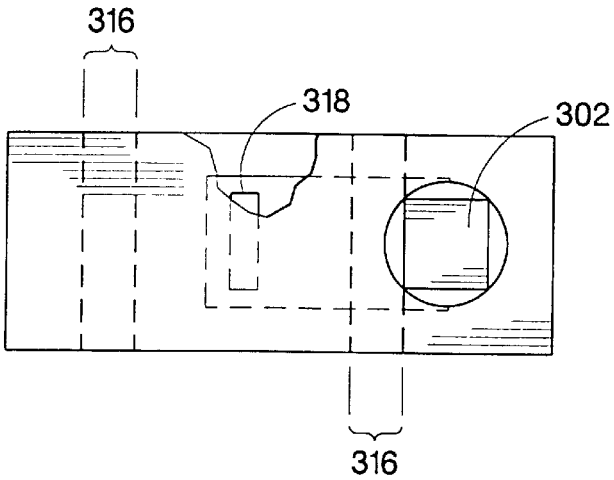
Figure 4A:
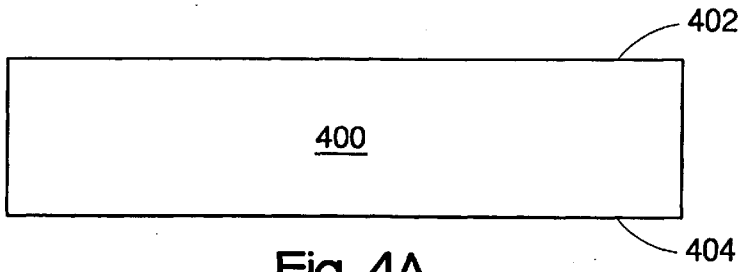
FIGS. 4A–D show cross sectional views depicting a process sequence for forming the thinfilm hard mask and polymer layer.
Figure 4B:
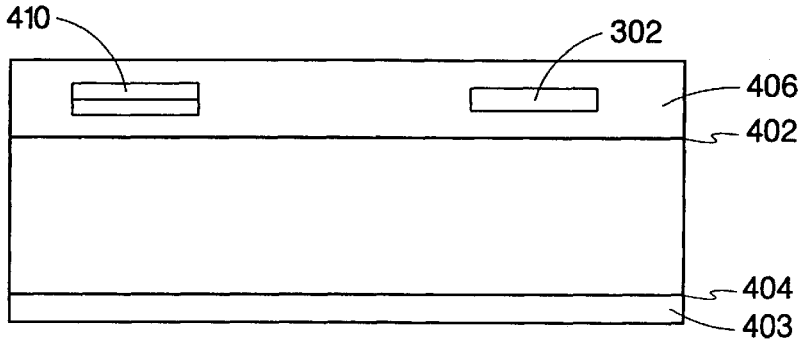

In accordance with a preferred embodiment of the current invention, ink feed channels 300 (as shown in FIG. 3*a*) are precisely manufactured in a substrate utilizing a two etch step micromachining technique. These ink feed channels serve as "ink inlets" for the printhead. FIG. 3B illustrates a variation of the printhead shown in FIG. 3A wherein the first etch of the aforementioned two etch step process removes a portion of the substrate, where wall 312 remains. The second etch step removes a remaining portion (second portion) of the substrate where wall 310 remains. Furthermore, the silicon ledge 316 created by the second etch process step provides structural support for a thinfilm material 314 that is formed on top of the substrate. The thinfilm material 314 contains an opening 318 that allows ink to flow from a reservoir, to a heater resistor 302 as shown in FIG. 3C which is a top view of FIG. 3B. A detailed description of preferred embodiments and method of manufacture of the present invention is forthcoming:

FIG. 4A shows a silicon substrate 400 consisting of a first surface 402 and a second surface 404. The crystallographic orientation of the silicon wafer is <100> although <110> may be used. A multilayer insulating film (or dielectric film) 406 comprised of tetra ethyl ortho silicate TEOS, silicon nitride, and silicon carbide with an intervening dual layer conductor consisting of tantalum-aluminum and aluminum is formed on the first surface 402. The intervening conductive layer forms the heater resistor 302 (through the selective removal of one film) and the electrical lines 410 through which power is supplied to adjacent heater resistors (the heater resistor and electrical lines are shown pictorially). A portion of a multilayer insulator hereinafter referred to as a thinfilm or thinfilm stack, is impervious to ink which may be corrosive. In this regard, the thinfilm protects the enclosed conductive layer 410, which is susceptible to ink corrosion.

Figure 4C:
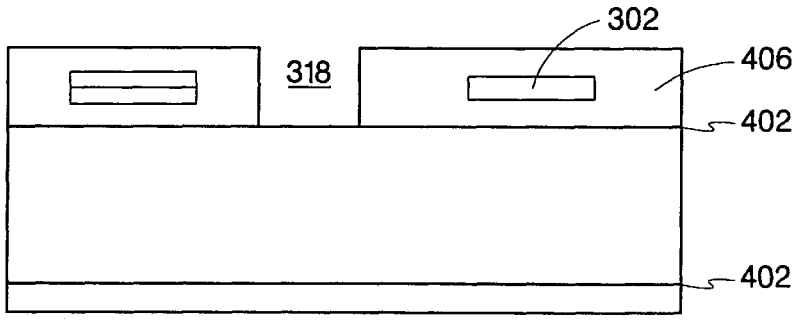

A masking material (hard mask) which protects the second surface 404 of the substrate 400 from being undesirably etched, is formed on the second surface 404. This film may be formed of gate oxide, nitride, carbide, a polymer, a metal, or a combination thereof. Next, as shown in FIG. 4C the thinfilm 406 is patterned forming an opening 318 through which ink flows thereby reaching the heater resistor 302. This opening 318 determines the final dimensions of the ink feed channel.

Figure 4D:
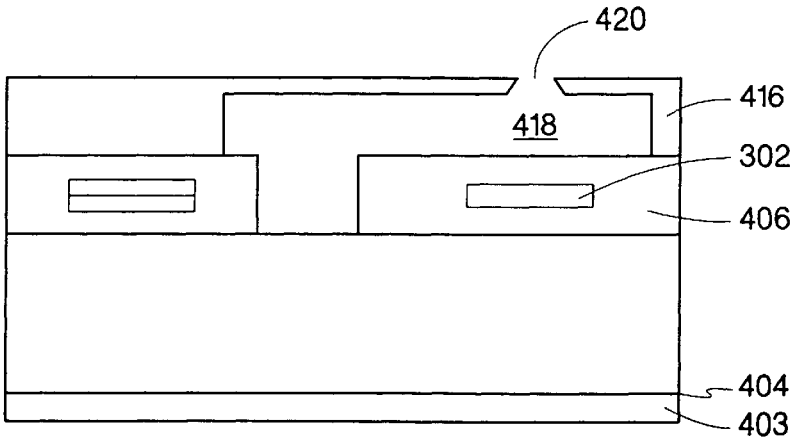
Figure 5A:
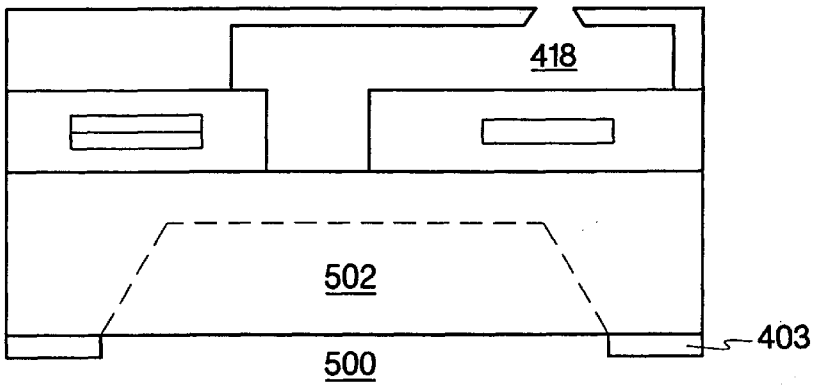
FIGS. 5A–C show cross sectional views depicting a process sequence for forming the first portion of the ink feed channel.
Figure 5B:
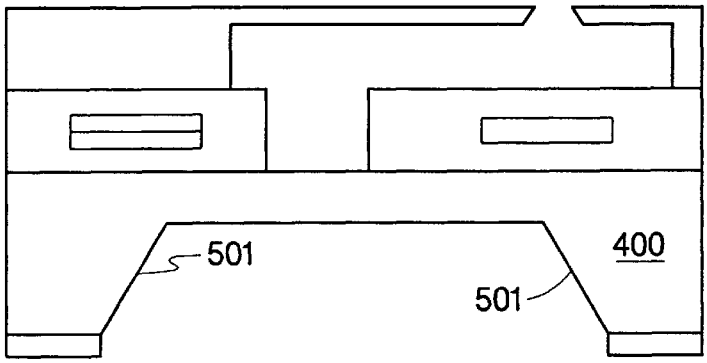

FIG. 4D shows a polymer 416 formed on top of the thinfilm 406. The polymer forms a chamber 418 around the heater resistor (a "firing chamber") and defines an orifice 420 through which ink is ejected onto a printing medium. Additionally, the polymer provides structural support for the thinfilm. Next, the hard mask 403 formed on the second surface 404 is patterned and etched, thereby defining the location of the ink feed channel 500 as shown in FIG. 5A. The first portion of the etch is conducted using a conventional wet etch chemistry consisting of a diluted mixture of potassium hydroxide (KOH) or TMAH. In an embodiment of the current invention, the hard mask is formed before the polymer is formed.

Figure 5C:
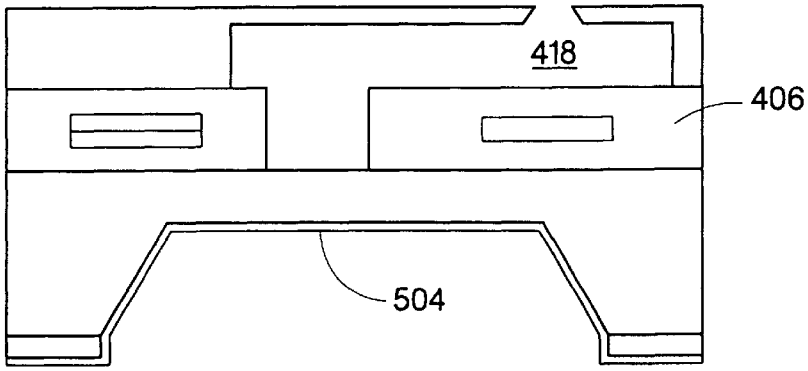
Figure 6A:
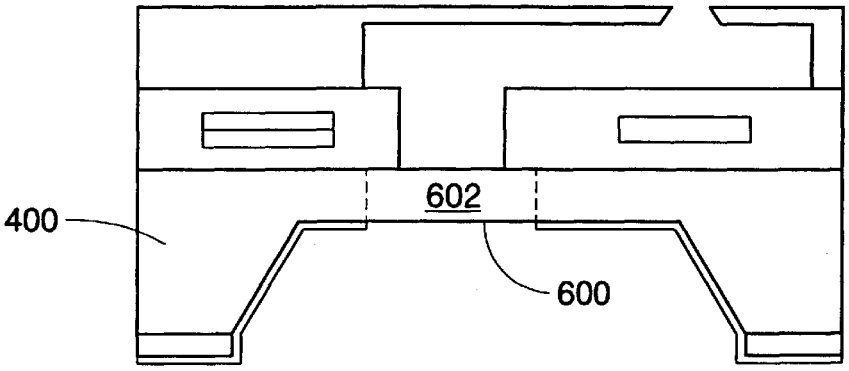
FIG. 6A shows silicon substrate wherein the photoresist has been exposed so that the second portion of the ink feed channel can be defined.
Figure 6B:
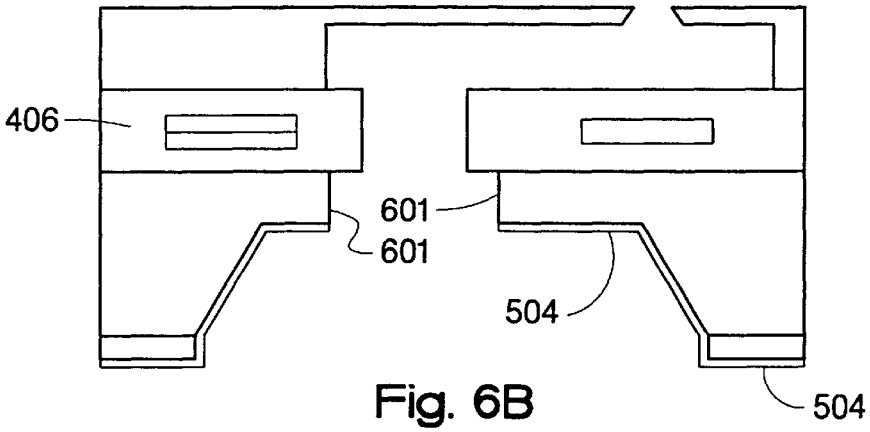
FIGS. 6B–C show a silicon substrate wherein the first and second portion of the ink feed channel have been etched thus providing a path for ink to travel from the inkjet cartridge to the heater resistor.
Figure 6C:
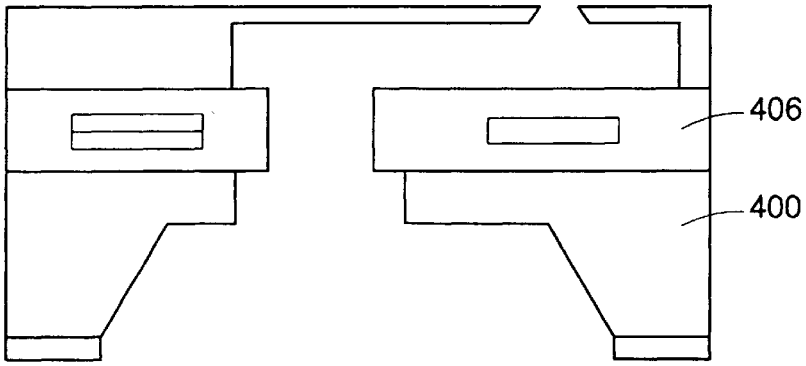

The first portion of the wet etch anisotropically removes a predetermined amount 502 shown in the dashed area of FIG. 5A of the silicon substrate 400, thus, leaving the ink feed channel partially etched thereby forming syncline sidewalls 501 consistent with the crystallographic orientation of the substrate. The partially etched ink feed channel is covered with photoresist 504 as shown in FIG. 5C. The photoresist is applied to the ink feed channel using a conformal coating technique, which may include extrusion coating, spray coating or dipping. The photresist 504 is then exposed in those areas 600 where the second portion of the ink feed channel etch will be performed (FIG. 6A). The second (and final) portion of the ink feed channel etch commences from the conclusion of the first etch. The second etch is preferably an anisotropic fluorine based plasma etch (dry etch). The fluorine-based plasma selectively etches a predetermined amount 602, shown in a dashed area of FIG. 6A, from the silicon substrate. Vertical sidewall 601 are formed while leaving the thinfilm 406 unscathed, as shown in FIG. 6B. FIG. 6C illustrates an embodiment of the present invention where the photoresist 504 has been removed.

Figure 7A:
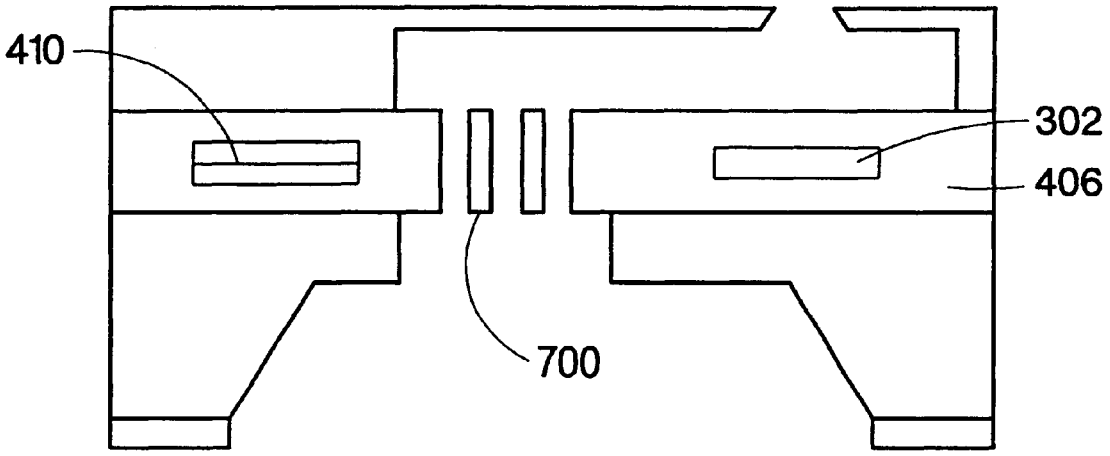
FIGS. 7A and 7B each show a preferred embodiment of the current invention wherein the thinfilm above ink feed channel includes an ink filter.
Figure 7B:
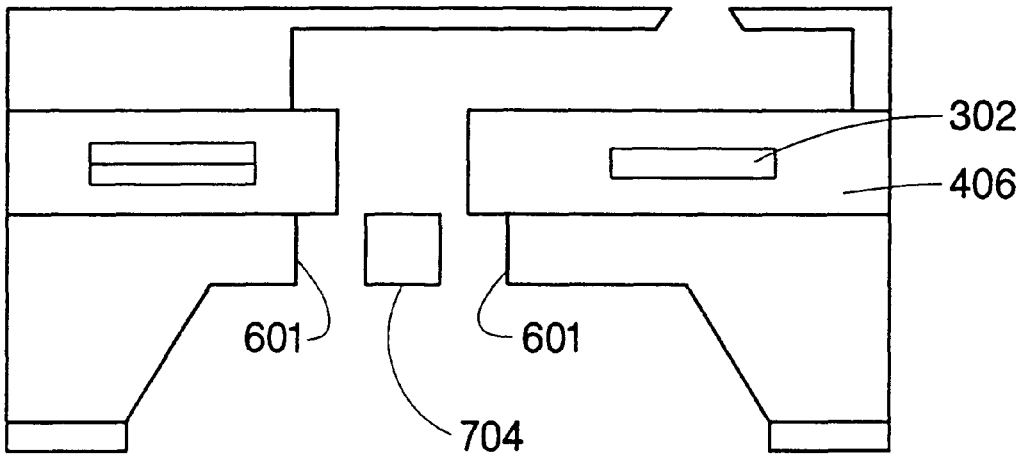

Many embodiments of the current invention may be fabricated utilizing the aforementioned process including, but not limited to: (a) a printhead wherein ink may be filtered before reaching the heater resistor, (b) a printhead wherein heater resistors are disposed in the thinfilm directly above the ink feed channel, (c) a printhead wherein the first portion of the ink feed channel is sufficiently narrow thus causing the crystallographic planes to merge at a predetermined distance, (d) a printhead wherein the first portion of the ink feed channel etch is isotropic, (e) a printhead wherein a dopant or epitaxial layer is disposed between the first and second silicon surfaces forming an etch stop, and (f) a printhead wherein a commercially available silicon on oxide (SOI) substrate is utilized. A description of the aforementioned printheads embodying the current invention is described below:

(a) FIG. 7A shows an embodiment of the present invention wherein a grid 700 is created in the thinfilm 406 which serves to filter the ink (an ink filter) as it passes through the ink feed channel in route to the heater resistor 302. If ink, being supplied to the ink filter, contains a particle of significant magnitude the particle may be trapped in the filter such that a portion of the ink feed channel remains open. Additionally, the grid provides support for the thinfilm 406. This support is of great benefit for those configurations (as described below) where the heater resistor 302 resides above the ink feed channel. FIG. 7B shows an embodiment of the current invention wherein the second portion of the ink feed channel has a segmented portion forming sub-channels. This configuration increases the structural support of the printhead. Additionally, a plurality of heater resistors 302 may be disposed in the thinfilm 406 on either side of the segmented portion of the ink feed channel.

Figure 8A:
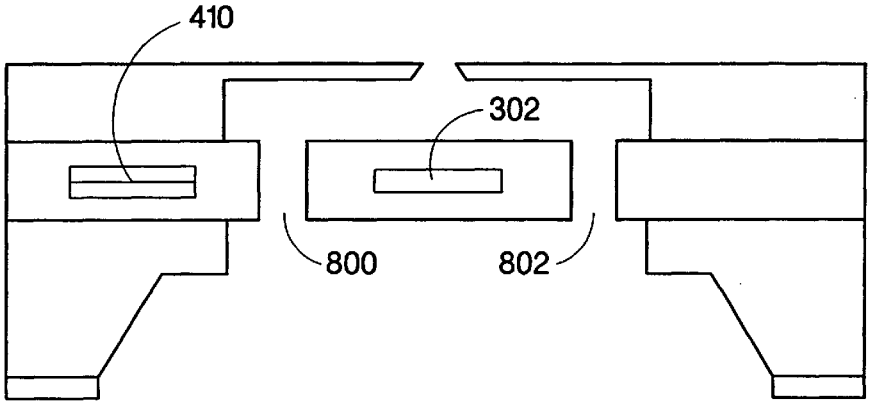
FIG. 8A shows an embodiment of the present invention wherein the heater resistor is disposed in the thinfilm directly above the ink feed channel.
Figure 8B:
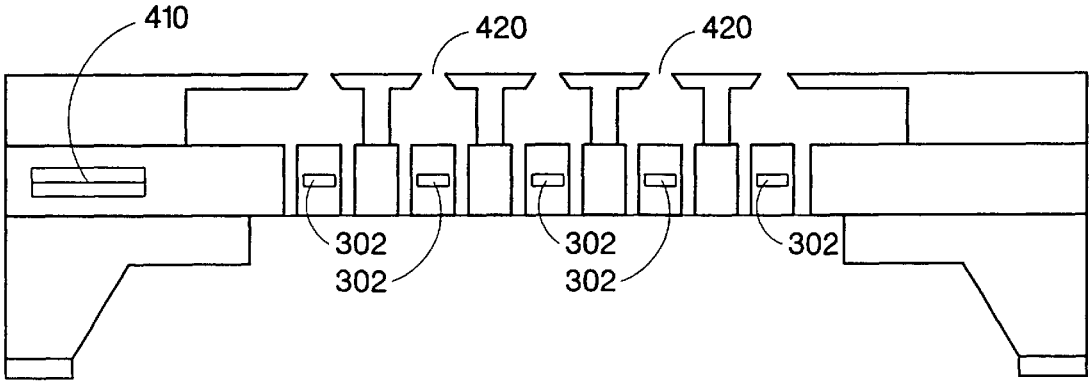
FIG. 8B shows an embodiment of the present invention wherein a multiplicity of heater resistors is disposed in the thinfilm directly above the ink feed channel.

(b) FIG. 8A shows an embodiment of the current invention wherein the heater resistor is disposed in the thinfilm directly above the ink feed channel. In this configuration, ink may reach the heater resistor from both sides 800, 802 of the ink feed channel. This configuration also provides a means for filtering the ink. For example, if opening 800 is clogged, ink may reach the heater resistor from opening 802. A multiplicity of heater resistors and accompanying nozzles (or orifices 402) may be disposed in a printhead employing this configuration, as shown in FIG. 8B. An embodiment as such allows for high resolution printing (high DPI printing).

Figure 9A:
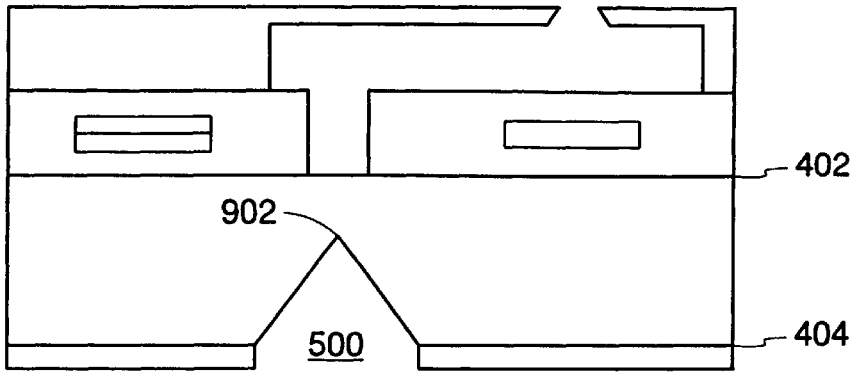
FIGS. 9A–B shows a printhead wherein the hard mask opening is substantially narrowed so that the crystallographic planes converge at a predetermined distance during the first etch.
Figure 9B:
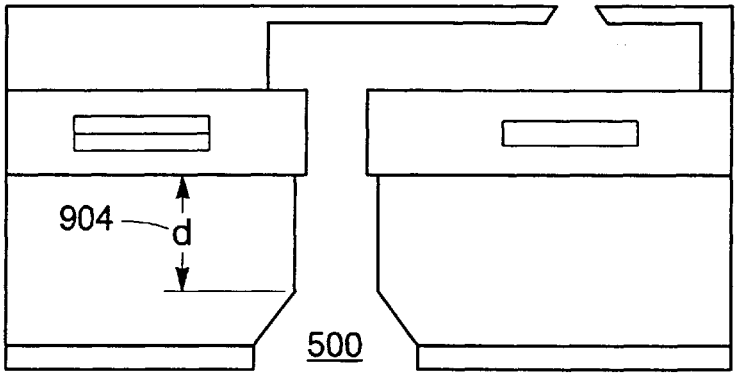

(c) FIG. 9A shows a printhead wherein the hard mask opening 500 is substantially narrowed. The final width chosen for the opening 500 allows the crystallographic planes to converge at point 902 at a predetermined distance between the first surface 402 and the second surface 404 (FIG. 9A). An advantage of this technique is better control of the wet etched ink feed channel dimension. Since the planes inherently converge at 54.7 degrees, the dry etch will repeatedly begin at the same depth, d, 904 into the substrate as shown in FIG. 9B.

Figure 10:
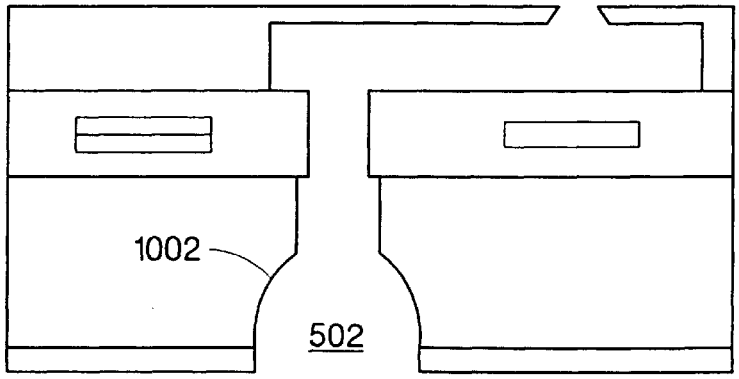
FIG. 10 shows a printhead wherein the first portion of the ink feed channel etch is conducted using an isotropic chemical etch.

(d) FIG. 10 shows a printhead wherein the first portion 502 of the ink feed channel etch is conducted using an isotropic chemical etch thereby forming an arch 1002 with concare walls. The isotropic characteristics of the etch stems from the rate at which the substrate etches which is far greater than the anisotropic wet etch previously described. An advantage of the isotropic wet etching technique is a reduction in processing time. The previously described anisotropy wet etch process may take in excess of 15 hours to achieve whereas the isotropic etch may be achieved in less than five hours.

Figure 11A:
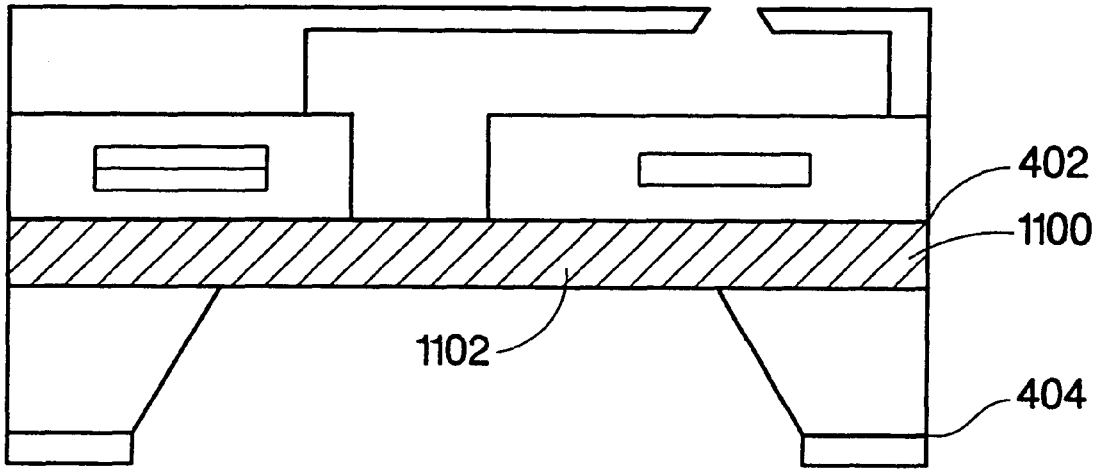
FIGS. 11A–B shows a printhead wherein the first surface of the silicon substrate is doped using, boron source in those regions where the ink feed channel is defined.
Figure 11B:
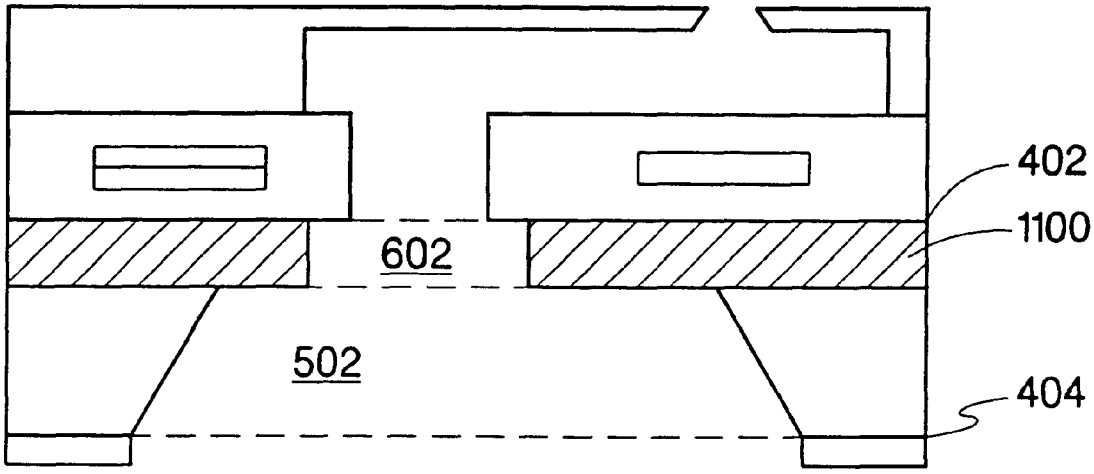

(e) FIG. 11A shows a printhead wherein the first surface of the silicon substrate is doped to form a doped layer 1100 using a boron source in those regions where the ink feed channel is defined. The dopants are diffused into the substrate at a predetermined depth that creates an interface 1102 between the first surface 402 and the second surface 404. The aforementioned interface serves as an etch stop (the wet etch will not penetrate the doped surface interface) distinguishing the first etch (FIG. 1A) from the second etch (FIG. 11B). This technique lessens the need to time the etch, thus creating a more robust process. Additionally, it is possible to create a similar etch stop by growing a boron doped epitaxial layer on the first surface. The boron doped epitaxial layer will impede the wet chemical etch in a manner similar to the boron doped surface.

Figure 12A:
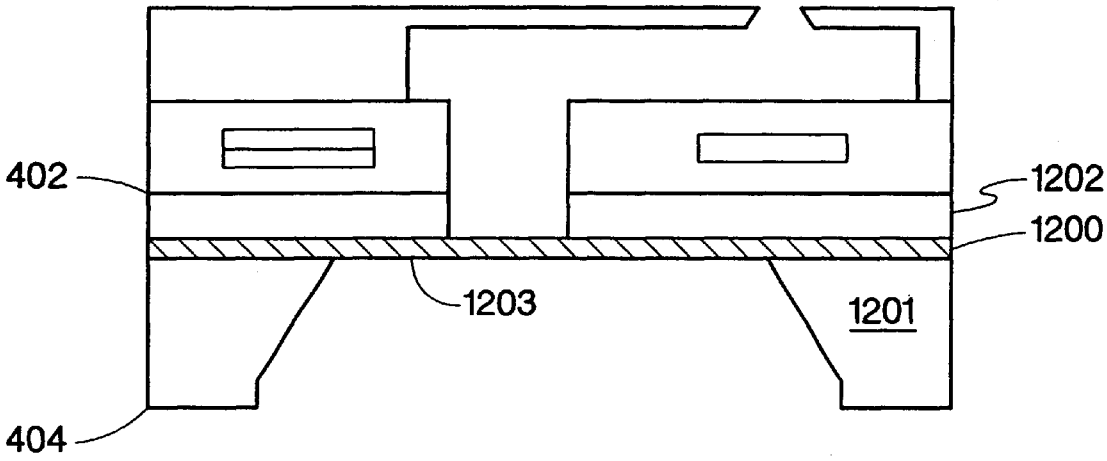
FIGS. 12A and 12B show a printhead fabricated on commercially available silicon on insulator substrate (commonly referred to as an SOI wafer).
Figure 12B:
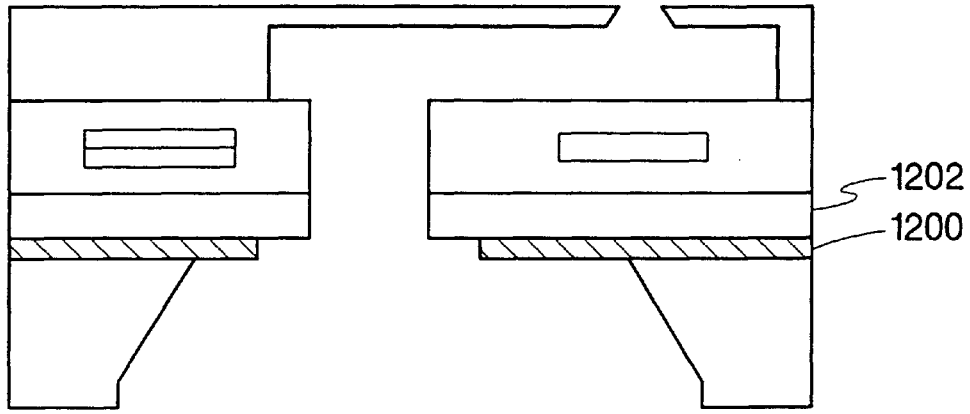

(f) FIG. 12A shows the printhead fabricated on a commercially available silicon on insulator substrate 1201 (commonly referred to as an SOI wafer). The intervening oxide layer 1200 between the first surface 402 and the second surface 404 (as shown in FIG. 12A) serves as an etch stop. This etch stop is similar to that described previously, however, a silicon layer 1202 resides above the oxide layer 1200. The ink feed channel is formed as described previously wherein the wet etch process is distinguished from the dry etch process by the intervening oxide layer 1200. However, the dry etch process commences from the oxide interface 1203 (that is made visible following the wet etch process) and etches the silicon layer 1202 on top of the intervening oxide 1200 layer. The resulting embodiment is shown in FIG. 12B. Alternatively, the silicon layer 1202 on top of the intervening oxide layer 1200 may be etched subsequent to the time when the opening 318 in the thinfilm layer is etched. The advantage of this technique is the ability to utilize the inherent etch stop (oxide layer) of the wafer (starting material) to reduce processing time.

Many of the aforementioned challenges associated with the fabrication of ink feed channels have been remedied through an embodiments of the current invention including: (1) precise control of ink feed channel dimensions, (2) a decreased distance through which ink flows before reaching the heater resistor, (3) the manufacturing time of the printhead is reduced (as compared to a conventional printhead) and (4) greater packing density of the heater resistors disposed in the printhead thereby leading to greater print resolution. Various changes and modifications of an obvious nature may be made to an embodiment of the current invention without departing from the spirit of the invention and all such changes and modifications are considered to fall within the scope of the invention defined by the depending claims.

We claim:

1. A substrate for an inkjet printhead comprising:

at least one crystallographic orientation;

at least two opposed planar surfaces having a first surface and a second surface;

a first section having a first material, and a second section having a second material different than the first material;

an etchstop being disposed between two opposed planar surfaces of the at least two opposed planar surfaces, wherein the etchstop is the second section; and an inkfeed channel having a first portion formed in said second surface of said at least two opposed planar surfaces and having a conclusion between said first surface and said second surface of said at least two opposed planar surfaces at said etch stop, and a second portion formed commencing from said conclusion of said first portion and terminating at said first surface thereby forming a channel completely through said substrate.

2. The substrate for the inkjet printhead of claim 1 wherein said second portion of said inkfeed channel is narrower than said first portion.

3. The substrate for the inkjet printhead of claim 1 wherein said first portion of said inkfeed channel is substantially trapezoidal in cross-section forming synclinal sidewalls consistent with said crystallographic orientation of said substrate.

4. The substrate for the inkjet printhead of claim 3 wherein said synclinal sidewalls converge between said at least two opposed planar surfaces.

5. The substrate of claim 4 wherein the sidewalls converge to a point.

6. The substrate for the inkfeed channel of claim 1 wherein said second portion of said inkfeed channel is substantially rectangular in cross-section forming vertical sidewalls relative to said first surface.

7. The substrate of claim 1 further comprising a dielectric film being formed on the first surface of said at least two opposed planar surfaces, the dielectric film having an opening positioned adjacent said inkfeed channel whereby ink flows through said channel.

8. The substrate for the inkjet printhead of claim 7 wherein said dielectric further comprises at least two openings spaced apart by a distance equal to particulate matter found in ink.

9. The substrate for the inkjet printhead of claim 7 wherein said dielectric film includes a plurality of openings.

10. The substrate of claim 1 wherein the etchstop is sandwiched in between sections of the substrate having the first material.

11. The substrate of claim 1 wherein the etchstop is adjacent the first opposed substrate surface.

12. The substrate of claim 1 wherein the substrate is an SIO substrate.

13. A substrate for an inkjet printhead comprising:

at least two opposed planar surfaces with a first surface and a second surface; and an inkfeed channel having a first portion formed in said second surface of said at least two opposed planar surfaces and having a conclusion between said first surface and said second surface of said at least two opposed planar surfaces, and a second portion formed commencing from said conclusion of said first portion and terminating at said first surface thereby forming a channel completely through said substrate, wherein said first portion of said inkfeed channel has at least two opposing concave walls.

14. An inkjet printhead comprising:

a substrate having at least one crystallographic orientation and at least two opposed planar surfaces;

an etchstop being disposed between two planar surfaces of said at least two opposed planar surfaces;

a first section of the substrate having a first material, and a second section of the substrate having a second material different than the first material, wherein the etchstop is the second section;

a dielectric film being formed on a first surface of said at least two opposed planar surfaces;

an inkfeed channel having a first portion formed in a second surface of said at least two opposed planar surfaces and having a conclusion at said etchstop, and a remaining portion formed commencing from said conclusion of said first portion thereby forming a channel completely through said substrate; and an opening in said dielectric film positioned adjacent said inkfeed channel such that ink flows through said inkfeed channel.

15. The inkjet printhead of claim 14 wherein said etchstop further comprises boron.

16. The inkjet printhead of claim 14 wherein said etch stop further comprises an epitaxial layer formed on said first surface of said at least two opposed planar surfaces.

17. The inkjet printhead of claim 14 wherein said etch stop further comprises an embedded oxide layer.

18. A print cartridge comprising:

an ink reservoir; and a printhead, said printhead having:

a substrate having at least one crystallographic orientation and at least two opposed planar surfaces;

a dielectric film being first surface of said at least two opposed planar surfaces;

an etchstop being disposed between two planar surfaces of said at least two opposed planar surfaces;

a first section of the substrate having a first material, and a second section of the substrate having a second material different than the first material, wherein the etchstop is the second section;

an inkfeed channel having a first portion formed in a second surface of said at least two opposed planar surfaces and having a conclusion between said first surface and said second surface of said at least two opposed planar surfaces and a second portion formed commencing from said conclusion of said first portion and terminating at said dielectric film thereby forming a channel completely through said substrate; and an opening in said dielectric film positioned adjacent said inkfeed channel whereby ink flows through said channel from said ink reservoir.

19. The print cartridge of claim 18 further comprising ink ejectors disposed in said printhead whereby ink from said reservoir is ejected onto a printing medium.

20. The print cartridge of claim 18 further comprising an ink ejector disposed adjacent said ink feed channel.

21. The print cartridge of claim 18 further comprising an ink inlet whereby ink is replenished to said print cartridge.

22. The print cartridge of claim 18 wherein said second portion of said inkfeed channel further comprises at least two sub-channels for the passage of ink.

23. A substrate for an inkjet printhead comprising:

at least two opposed planar surfaces having a first surface and a second surface; and an inkfeed channel having a first portion formed in said second surface of said at least two opposed planar surfaces and having a conclusion between said first surface and said second surface of said at least two opposed planar surfaces, and a second portion formed commencing from said conclusion of said first portion and terminating at said first surface thereby forming a channel completely through said substrate, wherein said first portion of said inkfeed channel forms sidewalls that converge to a point in between the first and second surfaces.

24. The substrate of claim 23 wherein the sidewalls of the first portion are concave thereby forming an arch.

25. The substrate of claim 23 wherein the substrate further comprises at least one crystallographic orientation, wherein the first portion is substantially trapezoidal in cross section forming synclinal sidewalls consistent with said crystallographic orientation of said substrate.

* * * * *